US005891568A

United States Patent [19]

Hartzog et al.

[11] Patent Number: 5,891,568

[45] Date of Patent: Apr. 6, 1999

[54] POLYESTER FIBER

[75] Inventors: James Victor Hartzog, Kinston, N.C.; Juergen Musch, Hamm, Germany; Darren Scott Quinn, Goldsboro, N.C.

[73] Assignee: E. I. du Pont de Nemours and Company, Wilmington, Del.

[21] Appl. No.: 942,352

[22] Filed: Oct. 1, 1997

Related U.S. Application Data

[60] Provisional application No. 60/028,064, Oct. 4, 1996.

[51] Int. Cl.[6] ..... D02G 1/00

[52] U.S. Cl. ..... 428/369; 428/371; 428/373; 428/374; 428/397; 428/398; 428/401

[58] Field of Search ..... 428/369, 371, 428/373, 374, 397, 398, 401

[56] References Cited

U.S. PATENT DOCUMENTS

| | | | |
|---|---|---|---|
| 3,595,738 | 7/1971 | Clarke et al. | 161/169 |
| 3,772,137 | 11/1973 | Tolliver | 161/169 |
| 5,104,725 | 4/1992 | Broaddus | 428/224 |
| 5,458,971 | 10/1995 | Hernandez et al. | 428/373 |

FOREIGN PATENT DOCUMENTS

| | | |
|---|---|---|
| 67684 A2 | 12/1982 | European Pat. Off. . |
| 1168759 | 10/1969 | United Kingdom . |

*Primary Examiner*—Richard Weisberger

[57] ABSTRACT

Improved polyester fibers, filling materials and filled articles are provided by fibers of helical configuration, high void content and low friction.

4 Claims, No Drawings

POLYESTER FIBER

CROSS-REFERENCE TO RELATED APPLICATION

This application claims benefit of priority from our Provisional Application No. 60/028,064, filed Oct. 4, 1996, now abandoned, and also from our PCT application, PCT/US97/15690 filed Sep. 5, 1997.

FIELD OF THE INVENTION

This invention concerns improvements in polyester fibers, and more particularly in such fibers that are useful as filling material, especially such fibers that have a helical configuration.

BACKGROUND OF THE INVENTION

Polyester fiberfill filling material (sometimes referred to herein as polyester fiberfill) has become well accepted as a reasonably inexpensive filling and/or insulating material especially for pillows, and also for cushions and other furnishing materials, including other bedding materials, such as sleeping bags, mattress pads, quilts and comforters and including duvets, and in apparel, such as parkas and other insulated articles of apparel, because of its bulk filling power, aesthetic qualities and various advantages over other filling materials, so is now manufactured and used in large quantities commercially. "Crimp" is a very important characteristic. "Crimp" provides the bulk that is an essential requirement for fiberfill. Slickeners, referred to in the art and hereinafter, are preferably applied to improve aesthetics. As with any product, it is preferred that the desirable properties not deteriorate during prolonged use; this is referred to generally as durability. Hollow polyester fibers have generally been preferred over solid filaments, and improvements in our ability to make hollow polyester fiberfill with a round periphery has been an important reason for the commercial acceptance of polyester fiberfill as a preferred filling material. Examples of prior cross-sections are those with a single longitudinal void, such as disclosed by Tolliver, U.S. Pat. No. 3,772,137, and by Glanzstoff, GB 1,168,759, and multi-void fibers, including those with 4-holes, such as disclosed in EPA 2 67,684 (Jones and Kohli), and those with 7-holes, disclosed by Broaddus, U.S. Pat. No. 5,104,725, all of which have been used commercially as hollow polyester fiberfill filling material. Most commercial filling material has been used in the form of cut fibers (often referred to as staple) but some filling material, including polyester fiberfill filling material, has been used in the form of deregistered tows of continuous filaments, as disclosed, for example by Watson, U.S. Pat. Nos. 3,952,134, and 3,328,850. We use herein both terms "fiber" and "filament" inclusively without intending use of one term to exclude the other.

Generally, for economic reasons, polyester fiberfill fiber filling material, especially in the form of staple, has been made bulky by mechanical crimping, usually in a stuffer box crimper, which provides primarily a zigzag 2-dimensional type of crimp, as discussed, for example, by Halm et al in U.S. Pat. No. 5,112,684. A different and 3-dimensional type of crimp, however, can be provided in synthetic filaments by various means, such as appropriate asymmetric quenching or using bicomponent filaments, as reported, for example, by Marcus in U.S. Pat. No. 4,618,531, which was directed to providing refluffable fiberballs (sometimes referred to in the trade as "clusters") of randomly-arranged, entangled, spirally-crimped polyester fiberfill, and in U.S. Pat. No. 4,794,038, which was directed to providing fiberballs containing binder fiber (in addition to the polyester fiberfill) so the fiberballs containing binder fiber could be molded, for example, into useful bonded articles by activating the binder fibers. Such fiberballs of both types have been of great commercial interest, as has been the problem of providing improved polyester fiberfill having "spiral crimp". The term spiral crimp is frequently used in the art, but the processes used to provide synthetic filaments with a helical configuration (perhaps a more accurate term than spiral crimp) does not involve a "crimping" process, in a mechanical sense, but the synthetic filaments take up their helical configuration spontaneously during their formation and/or processing, as a result of differences between portions of the cross-sections of the filaments. For instance, asymmetric quenching can provide "spiral crimp" in monocomponent filaments, and bicomponent filaments of eccentric cross-section, preferably side-by-side but also with one component off-centered, can take up a helical configuration spontaneously.

It has long been known that such helical bicomponent fibers have advantages over mechanically-crimped filling fibers, as disclosed, for example, by Clarke et al in U.S. Pat. No. 3,595,738. Clarke referred to such filaments as "possessing a three-dimensional crimp of the reversing helical type", and it is correct that the helixes are of the reversing helical type. For convenience herein, we shall mostly simply refer to such polyester fibers as being of helical configuration. However, Clarke emphasized that these advantages were "only apparent provided the scale of the helical crimp is within certain limits", and that "if the filaments have less than about 8 crimps per inch and a crimp index less than about 40%, the filling or stuffing material made therefrom has low resistance to compression". Clarke disclosed (in Table at top of cols 5 and 6) that the performance of webs of polyester fiber of "Sample No. 1 and Sample No. 2" having 7 and 8 "Average number of crimps" (per inch, i.e., 27.5 and 31.5 CPdm, crimps per dm), and with 39 and 52 "Average CI percent", was "Fibre carding poor; low web cohesion. Bulk: low resistance to compression", and that other samples, having at least 10 "Average number of crimps" (almost 40 CPdm), were "much superior" to those samples Nos 1 and 2.

Relatively few helical bicomponent fibers with longitudinal voids have been disclosed or been available hitherto. Clarke did not disclose any such fibers with voids. An improved type of bicomponent polyester multi-void fiberfill fiber of helical configuration (spiral crimp) has been disclosed by Hernandez et al. in U.S. Pat. Nos. 5,458,971 and 5,683,816. Hernandez also disclosed prior single void fibers sold commercially as H18Y by Unitika (who apparently also sell other hollow filaments referred to by other designations, such as H18X) and as 7-HCS by Sam Yang, and properties measured on such fibers, which are discussed hereinafter as comparisons.

SUMMARY OF THE INVENTION

We have now found, according to the present invention, that Clarke's teaching was contrary to surprising advantages that we have found in performance of helical fibers with longitudinal voids (such as have been taught generically by Hernandez) as improved filling material, provided that the helical fibers are made with a high void content, low crimp frequency (CF) and low friction.

Accordingly, we provide polyester fibers of helical configuration, of crimp frequency (CF) about 24 crimps per dm (CPdm, corresponding to about 6 crimps per inch, CPI) or less, of crimp take-up (CTU) about 35% or more, of BL2 about 0.75 to about 1.25 cm (corresponding to about 0.30 to about 0.50 inches) of void content (VC) at least 10% by volume, and that are coated with a durable slickener to provide a Staple Pad Friction (SPF) of 0.27 or less. The parameters are explained hereinafter under the heading "Test Methods".

Preferably fibers of the invention are provided with one or more of the following, CF of 22 CPdm (5.5 CPI) or less, CF of at least 12 CPdm (3.0 CPI), CTU of at least 37%, CTU of up to 45%, BL2 of at least about 0.95 cm (corresponding to about 0.38 in., BL2 of up to about 1.15 cm (corresponding to about 0.45 in.),VC of at least 18%, VC of up to as much as 28%, and/or SPF of at least 0.21.

According to another aspect of the invention, we provide polyester fibers of helical configuration, of crimp frequency (CPI) about 6.0 crimps per inch or less, of crimp take-up (CTU) about 35% or more, and of high void content (VC) at least 18% by volume, that are coated with a durable slickener to provide a Staple Pad Friction (SPF) of 0.27 or less. Such fibers are preferably provided with one or more of the following, CPI of 5.5 or less, CPI of 2.5 or more, CTU of at least 37%, CTU of up to 45%, VC of up to as much as 28%, SPF of at least 0.21.

Also provided according to the present invention are articles filled with such fibers as filling material, if desired blended with other filling materials, and other aspects of such improved filling material as we disclose and/or are known to those skilled in the art.

DETAILED DESCRIPTION OF THE INVENTION

Much of the technology pertaining to polyester fiberfill is disclosed in the art mentioned hereinbefore, which is hereby specifically incorporated by reference. Although the invention is more particularly described with reference to bicomponent fibers such as have been generically disclosed by Hernandez in U.S. Pat. No. 5,458,971, referred to hereinabove, the disclosure of which is included herein by reference, the invention is not believed to be limited only to such specific fibers, but is believed to apply more generally to filling fibers of helical configuration, high void content, low crimp frequency and low friction. Multi-void fibers are especially preferred. By multi-void fibers herein we mean fibers having more than one longitudinal void. Conventional dpf values are also disclosed in the art referred to hereinbefore, such as Hernandez. The art such as Hernandez also teaches how to control and vary fiber properties so as to obtain benefits such as are obtainable according to the present invention.

Test Methods

The parameters mentioned herein are standard parameters and are mentioned in the art referenced herein, as are methods for measuring them. Since methods can vary, especially for measuring bulk, methods used herein are summarized briefly:

Fiber Properties

Properties of the fibers are mostly measured essentially as described by Tolliver in U.S. Pat. No. 3,772,137, and as referenced by Hernandez in U.S. Pat. No. 5,458,971. BL1 and BL2 are normally TBRM height measurements in inches but have been converted into metric equivalents, i.e., cm herein (and the actual measurements in inches are given afterwards in parentheses for the Tables).

Crimp Frequency (CF)

These measurements were made as described by Tolliver in U.S. Pat. No. 3,772,137. In the Tables that follow in the Examples hereinafter the measurements per inch have been converted into CPdm (crimps per dm), which are the numbers given first in the Tables (followed by the crimps per inch in parentheses).

Properties of Filled Articles

Articles fabricated from a filling material having the most effective bulk or filling power will have the greatest center height. The "Initial Height" (IH) of the center of an article such as a pillow under zero load is determined after mashing in the opposite corners of the article several times (refluffing) and placing the pillow on the load-sensitive table of an Instron tester and measuring and recording its "Initial Height" (IH) at zero load in inches (the metric equivalent (cm) also being given in the Tables in parentheses). In the case of quilt-like or batting articles the refluffing step is omitted. The Instron tester is equipped with a metal disc presser foot that is 4 in. (about 10 cm.) in diameter. The presser foot is caused to compress the article by continuously increasing the load until 20 lbs. (about 9 Kg) is applied. Before the actual compression cycle in which measurements (including IH) are made and recorded, the article is subjected to one complete cycle of 20 lbs (9 Kg) compression and load release for conditioning. The height versus load compression curve is then obtained by determining the heights of the article at various loads over a second compression cycle. Softness can be determined by measuring the negative slope at a point along the curve. To quantify this, the raw data is first represented by a third order polynomial. The slope of the curve is calculated from the first derivative of the polynomial at the desired load. The Initial Softness is termed "IS". Subjective evaluations have shown us that an IS of greater than 1.0 is very desirable commercially. Thus, a higher "Initial Softness"(IS) value represents a softer article. The support response (SR) is this slope at the support load; for a pillow, the slope at 8 lbs (3.6 Kg) is taken to best represent the response to a weight of a human head, and is termed herein "$SR_8$", Both IS and $SR_8$, are measured in inches/lb (the metric equivalent (cm/Kg) also being given in the Tables in parentheses).

Crimp takeup (CTU) for rope, bundles and single fibers are measured as follows:

Rope Crimp Take-up

A rope of known denier at least 1.5 meters in length is prepared for measurement by placing a knot in both ends. The resulting sample is subjected to a load of 125 mg/den. Two metal clips are placed across the extended rope at a distance apart of exactly 100 centimeters. The two ends of the rope are cut off within 1–2 inches beyond the clips. The resulting cut band is hung vertically and the recovered crimped length between the clips is measured to the nearest 0.5 centimeters. Crimp take-up is calculated using the following equation $$\% CTU = \frac{A - B}{A} \times 100$$

where A is the extended length, 100 centimeters, B is the retracted crimp length in centimeters.

Bundle Crimp Take-up

A parallel bundle of crimped fibers of >1 inch (2.5 cm) in length is collected, weighed and the extended length measured. From the weight and length, the denier of the bundle is determined. The bundle is secured by a clamp near each end. The bundle is suspended vertically by one clamp and sufficient weight is added to the second clamp such that the total load including clamp is 125 mg/den. The length between the clamps of the extended bundle is measured to the nearest millimeter and recorded as A, the extended length. A mark is made on the fiber bundle at the lower clamp position and the lower clamp and weight is removed. The length between the mark and the upper clamp is measured and recorded as B, the recovered length. Crimp Take-up is calculated by $$\% CTU = \frac{A - B}{A} \times 100$$

Single Fiber Crimp Take-up

For single fibers of normal staple lengths the initial crimped length is taken to be the same as the recovered crimp length. A single fiber is clamped near one end and suspended vertically. The distance to the crimped end is measured to the nearest millimeter and recorded as B, the initial crimped length. Using tweezers the end of the fiber is clamped and tensioned until it is just straight. The extended fiber length from the upper clamp to the end of the fiber is measured and recorded as A, the extended length. % Crimp Take-up is determined from the formula $$\% CTU = \frac{A - B}{A} \times 100$$

When a filament's crimp completely recovers so the filament returns to its initial crimped length, then % CTU is approximately similar to Crimp Index as described by Clarke in U.S. Pat. No. 3,595,738.

Friction is measured by the SPF (Staple Pad Friction) method, as described hereinafter, and for example,in U.S. Pat. No. 5,683,811, referred to above.

As used herein, a staple pad of the fibers whose friction is to be measured is sandwiched between a weight on top of the staple pad and a base that is underneath the staple pad and is mounted on the lower crosshead of an Instron 1122 machine (product of Instron Engineering Corp., Canton, Mass.)

The staple pad is prepared by carding the staple fibers (using a SACO-Lowell roller top card) to form a batt which is cut into sections, that are 4.0 ins in length and 2.5 ins wide, with the fibers oriented in the length dimension of the batt. Enough sections are stacked up so the staple pad weighs 1.5 g. The weight on top of the staple pad is of length (L) 1.88 ins, width (W) 1.52 ins, and height (H) 1.46 ins, and weighs 496 gm. The surfaces of the weight and of the base that contact the staple pad are covered with Emery cloth (grit being in 220–240 range), so that it is the Emery cloth that makes contact with the surfaces of the staple pad. The staple pad is placed on the base. The weight is placed on the middle of the pad. A nylon monofil line is attached to one of the smaller vertical (WxH) faces of the weight and passed around a small pulley up to the upper crosshead of the Instron, making a 90 degree wrap angle around the pulley.

A computer interfaced to the Instron is given a signal to start the test. The lower crosshead of the Instron is moved down at a speed of 12.5 in/min. The staple pad, the weight and the pulley are also moved down with the base, which is mounted on the lower crosshead. Tension increases in the nylon monofil as it is stretched between the weight, which is moving down, and the upper crosshead, which remains stationary. Tension is applied to the weight in a horizontal direction, which is the direction of orientation of the fibers in the staple pad. Initially, there is little or no movement within the staple pad. The force applied to the upper crosshead of the Instron is monitored by a load cell and increases to a threshold level, when the fibers in the pad start moving past each other. (Because of the Emery cloth at the interfaces with the staple pad, there is little relative motion at these interfaces; essentially any motion results from fibers within the staple pad moving past each other.) The threshold force level indicates what is required to overcome the fiber-to-fiber static friction and is recorded.

The coefficient of friction is determined by dividing the measured threshold force by the 496 gm weight. Eight values are used to compute the average SPF. These eight values are obtained by making four determinations on each of two staple pad samples.

The invention is further illustrated in the following Examples; all parts and percentages are by weight, unless otherwise indicated; void contents for products according to the invention were measured by volume, as described by Most in U.S. Pat. No. 4,444,710, but conventionally are often given by area, as described by Broaddus in U.S. Pat. No. 5,104,725. The spinneret capillary used for spinning 3-hole polyester fiber in the Examples was as illustrated and described by Hernandez in U.S. Pat. No. 5,458,971.

EXAMPLE 1

Side-by-side bicomponent filaments were produced and processed essentially as described in Example 1 of U.S. Pat. No. 5,458,971, except as described hereinafter. The combined polymer throughput was 210 lbs/hr (about 95.5 Kg/hr) with the two molten polymer streams combined in a side-by-side manner at a ratio of 88.5% (A) and 11.5% "B" at a "B" polymer temperature of 284° C. using a meter plate with orifices just above each of 1176 spinneret capillaries and spinning at a rate of 0.1786 lbs/hr/capillary (0.081 Kg/hr/capillary) and 900 ypm (823 m/min). The post-coalesced filaments (with three equi-spaced and equi-sized longitudinal voids parallel to the fiber axis) were cross-flow quenched with air at 55 deg. F. (18 deg. C.) at a flow of 880 cubic feet/min (25 $m^3$/min) to give filaments having a void content of about 20% and a spun denier of 18 dpf (20 dtex). Several such bundles of filaments were grouped together to form a rope that was conventionally drawn in a hot wet spray draw zone at 90 deg. C. using a draw ratio of 3.15× and then immediately cooled to 45 deg. C. and the tension was removed, allowing the filaments to develop their inherent spiral crimp. A slickening agent containing polyaminosiloxane was applied to the rope, the resulting rope was laid down on a conveyor, relaxed in an oven at 175 deg. C., cooled, and an antistatic finish applied at about 0.12% (on weight of fiber). The rope, having a nominal final relaxed rope denier of 459,000 (509,500 dtex) was cut in a conventional manner to 3 in. (76 mm). The properties of the resulting sample were measured and are listed in Table 1 as Item 1A. This Item 1A is preferred according to the invention.

Properties of another sample, having a lower crimp frequency below the range preferred according to the invention, are also listed in Table 1 as Item 1B.

For comparison, properties of a sample that was not according to the invention, but was prepared similarly, except that the polymer ratio and polymer temperature were adjusted to obtain a higher level of crimp frequency, as required by Clarke in U.S. Pat. No. 3,595,738, are listed in Table 1 as Item 1X. Comparison of the three SPF values indicates the correlation between a low CF (which is desirable according to the invention) and a low SPF (which is also desired according to the invention).

Pillows were prepared by cutting the fibers to 1⅛" (2.9 cm) cut length, opening the fibers and blowing into a 20 in.×26 in. (51×66 cm) tick of 200 count, 100% cotton fabric. The fill was adjusted to give 16 oz. (0.45 kg )of fiber in each pillow. The pillows were then measured for height at 0.3, 1, 5, 10, 15, and 20 lb loads (0.14, 0.45, 2.3, 4.5, 6.8,and 9 Kg). Initial softness (IS) and support response ($SR_8$) were measured as described and are reported in Table 1.

Pillow measurements and subjective evaluations showed that Item 1X (of fibers having high crimp frequency) was clearly inferior in softness to both of the others. Item 1B with the lowest crimp frequency did not have as good support response, as compared with Item 1A. Item 1A had high initial softness combined with high support response, so gave the best results and is preferred.

TABLE 1

| | FIBER PROPERTIES | | | | | | PILLOW PROPERTIES | | |
|---|---|---|---|---|---|---|---|---|---|
| ITEM | CF | VC | CTU | SPF | BL2 | BL1 | IH | IS | $SR_3$ |
| 1A | 16 (4.1) | 19.5 | 41 | 0.22 | 0.99 (0.39) | 14.9 (5.85) | 8.3 (21) | 1.36 (7.6) | 0.33 (1.8) |
| 1B | 11 (2.9) | 18.7 | 39 | 0.19 | 0.86 (0.34) | 14.6 (5.75) | 8.1 (20) | 1.37 (7.7) | 0.22 (1.2) |
| 1X | 34 (8.6) | 16.5 | 40 | 0.33 | 1.40 (0.55) | 13.9 (5.49) | 8.1 (21) | 0.92 (5.2) | 0.33 (1.8) |

EXAMPLE 2

2(1)—Bicomponent filaments were produced and processed essentially as described in the foregoing Example 1, except as follows. The combined polymer throughput was 170 lbs/hr (about 77 Kg/hr) with the two molten polymer streams combined in a side-by-side manner at a ratio of 88% "A" and 12% "B" at a "B" polymer temperature of 283° C. and the filaments were spun at 600 ypm (550 m/min) at a rate of 0.144 lbs/hr/capillary (0.066 Kg/hr/capillary), and quenched with air flow of 1250 cubic feet/min (35 $m^3$/min) to give filaments having a void content of 22%. Bundles of filaments were grouped together to form a rope having a final relaxed rope denier of 506,000 (562,000 dtex) and then drawn 3.5×, and finally cut in a conventional manner to 3 in. (76 mm). Properties were measured and are listed in Table 2A, as well as those for T-514, for comparison. T-514 is a blend of slickened mechanically-crimped poly(ethylene terephthalate) fibers of 5.5 dpf (6 dtex), cut length about 3 inches (7.5 cm), that is commercially available from DuPont and comprises a blend of 7-hole fibers, as disclosed by Broaddus in U.S. Pat. No. 5,104,725, and 4-hole fibers, as disclosed in EPA 267,684 (Jones and Kohli), and is compared with the fibers of Example 2(1), as described hereinafter.

2(2)—Bicomponent filaments of somewhat higher dpf were spun and processed essentially as described in the foregoing Example 2.1, except for using a combined polymer throughput of 210 lbs/hr (about 96 kg/hr), a "B" polymer temperature of 285° C. and a spin speed of 900 ypm (823 m/min), and the rope was drawn 3.15× at 98 deg. C. and relaxed (after slickening and being allowed to "free fall" onto a moving conveyor belt) at 170 deg. C. to give a relaxed tow denier totalling 825,000 (917,000 dtex). The properties were measured and are also shown in Table 2A.

Table 2A also includes properties of a commercial product sold by Sam Yang, designated as "7-HCS", for comparison. 7-HCS has been referred to in above-mentioned U.S. Pat. No. 5,458,971; the void content (VC) for the 7-HCS was measured by area from a magnified photograph of cut cross-sections. The crimp frequency for the 7-HCS has been given an asterisk (*) because it was variable, ranging from 13 to 21 CPdm (3.4 to 5.4 CPI); this indicates poor product uniformity for 7-HCS.

TABLE 2A

| ITEM | DPP (dtex) | VC | CF | CTU % | SPF | TBRM BL1 | TBRM BL2 |
|---|---|---|---|---|---|---|---|
| Ex 2(1) | 6.5 (7.2) | 22 | 18 (4.5) | 39 | 0.24 | 14.5 (5.69) | 1.02 (0.40) |
| Ex 2(2) | 7.9 (8.8) | 22 | 19 (4.7) | 40 | 0.27 | 14.6 (5.73) | 1.07 (0.42) |
| T-514 | 5.7 (6.3) | 17 | 21 (5.3) | 30 | 0.27 | 14.4 (5.67) | 1.15 (0.47) |
| 7-HCS | 7.0 (7.8) | 4 | * | 51 | 0.25 | 14.6 (5.76) | 0.91 (0.36) |

Cut fibers from Example 2(1) and from T-514 were processed into battings and made into quilts weighing 12 oz/sq. yard (0.4 Kg/$m^2$) using conventional quilt processing. The quilt from Example 2(1) was subjectively rated as softer, having more filling power, faster recovery after compression, and better drapability than the quilt made similarly from the commercial blend, T-514. Testing of the quilts for loft (using the Dynamic Load Test TTM) and for thermal resistance (according to British Standard BS 5335:1984) confirmed that the quilt from Example 2(1) had higher loft and a better warmth-to-weight ratio (measured in tog $cm^2$/gm), as shown in Table 2B, which gives also the improvements (Δ%) obtained by using the fiber of the invention (as well as metric equivalents of the raw IH data in parentheses in cm).

TABLE 2B

| ITEM | IH | WARMTH-TO-WEIGHT RATIO |
|---|---|---|
| Ex 2(1) | 10 (26) | 160 |
| T-514 | 8.6 (22) | 147 |
| Δ % | 17 | 8 |

Mini-quilts were also prepared by carding each of the products of Example 2(1) and of T-514, cutting webs to 18.5" by 25" (47×64 cm), and then stacking the webs to form thinner and thicker stacked battings prepared in this manner from each item at 8 oz per sq. yard (0.3 kg/$m^2$) and 12 oz per sq. yd (0.4 kg/$m^2$). Each batting was stuffed into a loose quilt tick and assessed for loft. The lofts of the quilts from Example 2(1) and from the commercial fiber T-514 were quantified by measuring the center heights of the mini-quilts under zero load in inches (cm in parentheses), as shown in Table 2C with the improvements (Δ% ) obtained by using the fiber of the invention.

TABLE 2C

| | MINI-QUILT HEIGHTS | |
|---|---|---|
| ITEM | THINNER | THICKER |
| Ex 2(1) | 4.46 (11.3) | 5.10 (13.0) |
| T-514 | 4.22 (10.7) | 4.42 (11.7) |
| Δ % | 6 | 11 |

Pillows were prepared as described in Example 1 from the fibers indicated in Table 2D and were then measured for height at those loads, and the heights from these compressions are shown in Table 2D in inches (equivalents in cm being shown in parentheses).

TABLE 2D

| ITEM | PILLOW HEIGHTS UNDER INDICATED LOADS | | | | | |
|---|---|---|---|---|---|---|
| | 0.3 | 1 | 5 | 10 | 15 | 20 |
| 7-HCS | 7.544 (19.2) | 6.450 (16.4) | 3.124 (7.9) | 1.655 (4.2) | 1.116 (2.8) | 0.894 (2.8) |
| Ex 2.1 | 8.139 (20.7) | 7.163 (18.2) | 3.939 (10.0) | 2.145 (9.5) | 1.405 (3.6) | 1.080 (2.7) |
| Ex 2.2 | 8.204 (20.8) | 7.321 (18.6) | 4.402 (11.2) | 2.535 (6.4) | 1.533 (3.9) | 1.070 (2.7) |

As explained previously (Test Methods for Filled Articles), this data can be better examined by plotting Height vs. Load to yield a compression curve for the pillows. Such calculations were made from the data in Table 2D and gave the data in Table 2E, $H_{10}$ and $H_{20}$ being the heights under those loads in pounds. It is readily apparent that the commercial fiber (7-HCS) is inferior to the fibers of the invention as regards initial loft and in response to load in the support region, i.e., change in height between $H_{10}$ and $H_{20}$. Calculating the delta change in height as a percentage versus 7-HCS indicates that these fibers of the invention did not "bottom out" but continued to show support at greater loads, lbs. while demonstrating a desirable level of softness at low loads. This data confirms that the 7-HCS fiber of the art (which has low crimp frequency) performs as predicted by Clarke, i.e., that fiber provides less support in that there is less response to load (change in height) in this support region. Surprisingly, however, the fibers according to our invention showed significantly different and better behavior, namely excellent initial height, softness greater than 1.0 and yet sufficient support, as evidenced by their height retention and response to loads beyond $H_{10}$.

TABLE 2E

| ITEM | IS | $S_8$ | $H_{10}$ | $H_{20}$ | $H_{10}$–$H_{20}$ | Δ VS 7-HCS |
|---|---|---|---|---|---|---|
| 7-HCS | 1.329 (7.4) | 0.28 (1.56) | 2.655 (4.2) | 0.894 (2.3) | 0.761 (1.9) | 0% |
| Ex 2.1 | 1.210 (6.8) | 0.35 (1.96) | 2.165 (5.5) | 1.080 (2.7) | 1.085 (2.8) | 43% |
| Ex 2.2 | 1.052 (5.9) | 0.36 (2.01) | 2.535 (6.4) | 1.070 (2.7) | 1.465 (3.7) | 92% |

In contrast to 7-HCS (a prior art fiber having a low void content), H18Y is a prior art fiber having high void content. As can be seen from measurements in Table 1A of Hernandez U.S. Pat. No. 5,458,971, H18Y fibers did not give a BL2 of about 0.75 to about 1.25 cm, but a significantly higher BL2 of 1.42 cm, which is not within present invention. The effect of varying void content for fibers of the present invention is shown in the following Example 3.

EXAMPLE 3

Spiral crimp bicomponent fibers of different void contents were produced as described in Example 1, except that the amounts of quench air were adjusted to make changes in the % void. The resulting fibers were cut to 2.5 in. (64 mm), carded into batts, cut into 6 inch (15 cm) squares and stacked until the total weight of the batt was 20±0.3 grams. Initial batt heights were measured in inches (metric equivalents are given in parentheses). Results are summarized in Table 3.

TABLE 3

| ITEM | CF | % VOID | CTU | SPF | BL1 | BL2 | BATT HEIGHT |
|---|---|---|---|---|---|---|---|
| 3A | 17 (4.3) | 14.0 | 40 | 0.24 | 14.2 (5.60) | 1.02 (0.40) | 6.02 (15.3) |
| 3B | 16 (4.1) | 17.5 | 40 | 0.25 | 14.8 (5.81) | 0.99 (0.39) | 6.32 (16.1) |
| 3C | 18 (4.5) | 23.5 | 46 | 0.23 | 15.7 (6.17) | 1.05 (0.43) | 6.58 (16.7) |

As may be seen from the data, higher void levels gave increased batt height (higher loft).

We have found that, when the crimp frequency and the CTU were very low, the SPF was also much lower, only 0.18, and the resulting fiber did not have sufficient cohesion to process satisfactorily on a card. Such low SPF fiber could however be processed differently, e.g., by blowing.

EXAMPLE 4

Fiber sample 4X was prepared essentially as described for Example 1 except the aminosiloxane was sprayed on only some of the fibers, which gave the sample an SPF of 0.32, which is a higher fiber-to-fiber friction than is desired, according to the invention. A portion of this sample, however, was submerged in a 0.5% solution of the aminosiloxane to ensure complete surface coverage and the resulting fiber (4A) with surface coating was cured at 175 degrees C. for 8 minutes to give an SPF of 0.26 which is low enough to be desirable according to the invention. Fibers of 1⅛ inch (29 mm) from both samples were blown into 16 ounce (0.45 Kg) pillows and the resulting pillows characterized. Results are listed in Table 4 and show that the lower fiber-to-fiber friction gave a significantly loftier pillow, was softer and gave better response to load at 8 pounds.

TABLE 4

| ITEM | SILICONE APPLICATION | CF | CTU | BL1 | BL2 | SPF | IH | IS | $SR_1$ |
|---|---|---|---|---|---|---|---|---|---|
| 4X | Poor | 19 (4.9) | 37 | 14.9 (5.88) | 1.40 (0.55) | 0.32 | 7.0 (18) | 0.88 | 0.11 (0.6) |
| 4A | Good | 18 (4.7) | 37 | 14.3 (5.62) | 1.27 (0.50) | 0.26 | 8.4 (21) | 1.11 | 0.36 (2.0) |

We claim:

1. Bicomponent Polyester fibers of helical configuration, of crimp frequency (CF) about 24 crimps per dm (CPdm) or less, of crimp take-up (CTU) about 35% or more, of BL2 about 0.75 to about 1.25 cm, of void content (VC) at least 10% by volume, and that are coated with a durable slickener to provide a Staple Pad Friction (SPF) of 0.27 or less.

2. Polyester fibers according to claim 1, wherein the void content (VC) is at least 18% by volume.

3. Polyester fibers according to claim 1, wherein the crimp frequency is at least 14 CPdm.

4. Polyester fibers according to claim 2, wherein the Staple Pad Friction (SPF) is at least 0.21.

* * * * *